United States Patent [19]

Smith

[11] Patent Number: 4,632,716

[45] Date of Patent: Dec. 30, 1986

[54] WOVEN LOW PERMEABILITY FABRIC AND METHOD

[75] Inventor: Richard W. Smith, Greenville, S.C.

[73] Assignee: Wangner Systems Corporation, Greenville, S.C.

[21] Appl. No.: 502,325

[22] Filed: Jun. 8, 1983

[51] Int. Cl.[4] ..... B32B 31/00

[52] U.S. Cl. ..... 156/148; 139/383 A; 139/425 A; 156/290; 156/308.4; 162/DIG. 1; 428/193; 428/257

[58] Field of Search ..... 156/148, 296, 308.4, 156/290; 428/257; 28/142; 139/383 A, 425 A; 162/DIG. 1, 148; 57/237, 243; 34/243 F

[56] References Cited

U.S. PATENT DOCUMENTS

| | | | |
|---|---|---|---|
| 4,093,512 | 6/1978 | Fleischer | 139/383 A |
| 4,105,495 | 8/1978 | Pai | 428/395 |
| 4,351,874 | 9/1982 | Kirby | 428/257 |
| 4,467,839 | 8/1984 | Westhead | 428/259 |

FOREIGN PATENT DOCUMENTS

| | | | |
|---|---|---|---|
| 1220531 | 1/1971 | United Kingdom | 139/383 A |
| 2097435 | 11/1982 | United Kingdom | 139/383 A |

*Primary Examiner*—James J. Bell
*Attorney, Agent, or Firm*—Cort Flint

[57] ABSTRACT

A woven dryer fabric A having a low fabric permeability characteristic is disclosed having multiple layers in which an intermediate layer includes cabled multi-filament weft elements (B) consisting of low-melt monofilament strands twisted together which are melted in the fabric to effect closure of the fabric mesh. In the weaving process, the cabled multi-filament weft elements have a softer texture which renders them more flexible and allows a more dense mesh count to provide for greater pre-melt void coverage. After melt, the multi-filaments become fused and flow into the void areas of the shed for more complete void coverage.

4 Claims, 8 Drawing Figures

WOVEN LOW PERMEABILITY FABRIC AND METHOD

BACKGROUND OF THE INVENTION

The invention relates to paper machine clothing useful for fabrication of dryer felts and the like which are employed in the dryer section of a papermaking machine to dry paper in web or sheet form.

In the papermaking machine, an aqueous suspension of fibers is transformed in stages into a paper web which is passed about an array of heated cylinders in order to dry the paper web. As the paper web passes over the dryer cylinders, it is held in contact with the cylinders for drying by a belt, commonly referred to as a dryer felt or fabric which has been made endless by techniques well known in the art.

The dryer fabrics are typically woven, nonwoven, or of a needle construction. The paper web dries from the heated cylinder outwardly through the dryer fabric which presses the paper web in intimate contact with the heated cylinder. Thus, the dryer fabric must possess a sufficient amount of permeability in order that the fabric breathe and allow the paper web to dry. The permeability characteristic of the dryer fabric is also important in reducing paper flutter. This is often caused through a pumping action of the air surrounding the moving fabric which causes the paper to leave the fabric momentarily. If the fluttering becomes excessive, the paper will be marked when it strikes the fabric upon returning. The permeability characteristic of the fabric is also important in regards to the type of paper which is being dried on the fabric.

Because of the conditions under which the dryer fabric is used, the dryer fabric accumulates various particulate matter from the papermaking process which, if left to accumulate in the open mesh of the fabric, can affect the permeability of the fabric. The fabric must then be cleaned by various processes well known in the papermaking art.

Fabrics constructed from monofilament material have been recognized for their cleanability and are highly desirable from this standpoint. However, the provision of a monofilament fabric with a low permeability characteristic is a problem due to the stiffness of the monofilament strands compared to spun and multifilament fibers. In the weaving of monofilament, void spaces in the fabric are created by the weaving of the relatively stiff monofilament strands and inability of the monofilament warp strands to conform to the shape of the weft strand which leaves the fabric open and limits the low permeability range of the fabric.

Conventional fabric woven from multi-filament strands suffer from lack of cleanability due to the fibrous affect of the fibers and moisture absorptivity thereof. Moreover, it has always been thought that multi-filament wire is less desirable in papermaking fabrics since it was believed that such fabrics had less dimensional stability in the cross-machine direction due to the tendency of the elements of the fibrous material in a multi-filament yarn to slide over one another.

Attempts to close up monofilament fabric and provide a lower permeability characteristic in the fabric has been made by weaving a multi-layer fabric in which an intermediate layer includes stuffer filling yarns such as in U.S. Pat. No. 4,274,448. The stuffer yarn is a monofilament or multi-filament core with a sheath made from asbestos or other soft material. The desirable cleaning characteristics of monofilament fabric are thus not entirely provided. While the stuffer filling yarn provides a closer fit in the intermediate layer, the yarns are also more difficult to weave owing to their size and nature. When placing the stuffer yarns under tension during weaving, care must be taken that the sheath does not slide over the core material.

U.S. Pat. No. 4,224,372 discloses a multi-layered dryer fabric which includes an intermediate layer in which a core yarn is woven in the filling direction which has a coating of a thermoplastic resin foam forming composition. After weaving, the fabric is heated which causes the coating composition to foam whereby empty spaces in the intermediate layer are filled up by the closed cell foam material formed in situ which binds with the remaining fabric structure. After repeated use under high temperatures in the high temperature environment of a dryer section of a papermaking machine, the probability exists of the resin binder breaking down and disassociating with the fabric structure causing changes in the fabric permeability and fabric stability.

U.S. Pat. No. 4,351,874 discloses a low permeability dryer fabric woven from monofilament plastic warp and weft strands wherein a weft stuffer strand is utilized which exhibits preferential softening under the influence of heat. The strands soften to adapt and conform to mesh interstices and thereby restrict the passages of air through the fabric. However, in the case of most monofilament, the monofilament stuffer is relatively stiff and hard to weave leaving significant pre-heating void areas in the weave and a fairly open mesh fabric after weaving. Therefore, even with heat softening of the filler after weaving, the closing of the fabric and permeability in the low range is limited.

Accordingly, an important object of the present invention is to provide a dryer fabric for a dryer section of a papermaking machine which is constructed from a monofilament material affording ease of cleanability yet has a low permeability characteristic.

Another important object of the present invention is the provision of a woven low permeability dryer fabric having a filling element woven in the fabric subjected to melt during heat treatment to close the mesh openings in the fabric yet which is textured soft for weaving to provide a more closed pre-melt mesh whereby a very low permeability characteristic is afforded.

Still another important object of the present invention is to provide a dryer fabric for a papermaking machine constructed from polymeric monofilament material in which open spaces in the sheds are closed by multi-filament weft yarns consisting of twisted low-melt monofilament strands interlocked in the fabric by heat expansion.

Still another important object of the present invention is to provide a woven monofilament multi-layered dryer fabric in which a low-melt polymeric multi-filament weft element is woven in intermediate layers to afford more pre-melt closure of void areas in the sheds whereafter the multi-filament weft element is heated and expands further filling the void areas in the intermediate fabric structure.

SUMMARY OF THE INVENTION

The above objectives are accomplished according to the present invention by incorporating in a woven multi-layer dryer fabric woven from monofilament warp and weft elements, a plurality of weft elements in an intermediate layer which consists of low-melt monofilament strands twisted together in spiraled undulations creating knuckles.

The monofilament strands consist of small diameter strands of low-melt nylon cabled together to provide a weft element having an effective overall diameter generally equal to that of a single monofilament element. However, the cabled element has a much softer texture and weaving characteristic. A much closer pre-melt weave is achieved in which void areas in the intermediate sheds are further reduced during heat treatment.

The individual twisted monofilament strands become fused in the melt configuration and increases fabric stability by interlocking between adjacent warp strands while closing the open shed areas in the intermediate layer to give the fabric a low permeability characteristic. The low-melt polymeric material is heated only slightly at its melting point sufficiently to cause the material to expand but without causing significant change in its physical or chemical state. The low-melt polymeric material resists heat and remains physically stable during repeated use in the dryer section of the papermaking machine.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention relates to a method and construction of a dryer fabric for the dryer section of a papermaking machine. The principles and structure applied herein may also be applicable to paper clothing for other sections of papermaking machines and other applications for sieve belts and fabrics. Since papermaking machines and processes are well known in the art, only so much of a papermaking machine and process as is necessary to an understanding and illustration of the invention will be made herein.

Figure 1:
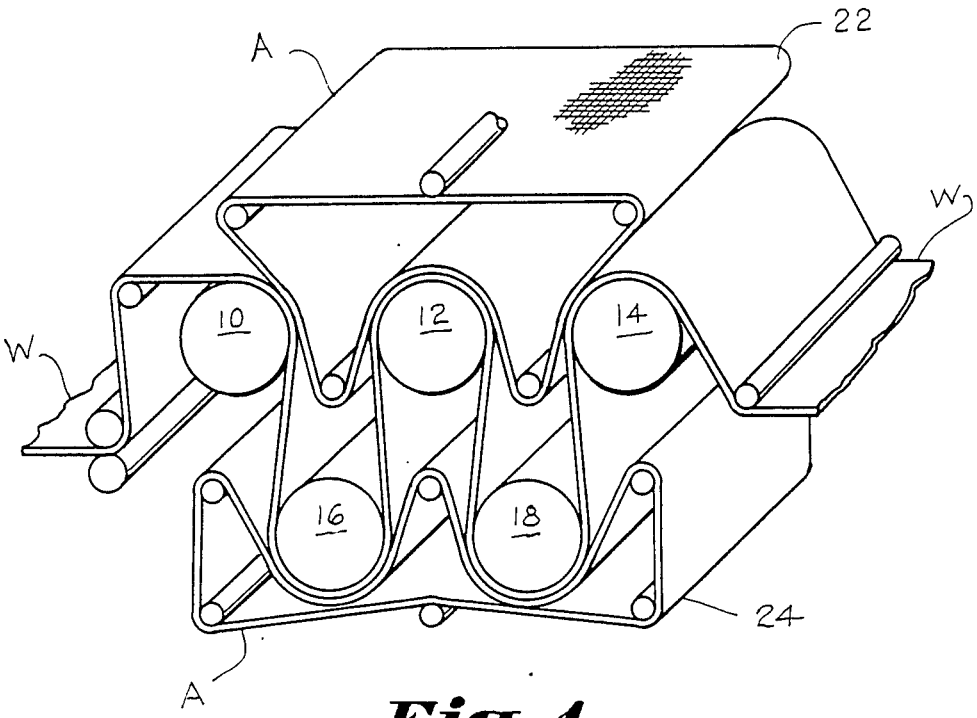
FIG. 1 is a schematic illustration of a dryer section of a papermaking machine.

FIG. 1 is a simplified view of a portion of a dryer section of a papermaking machine wherein a continuous sheet-like web W of paper material is travelling from left to right. The dryer section may include an upper and lower array of horizontally disposed heated dryer cylinders. The upper array of heated cylinders includes cylinders 10 through 14 with lower array including cylinders 16 through 18. The paper web passes over and about the heated cylinders in a serpentine path. Water and other fluids within the paper web are evaporated due to the paper contacting the heated cylinders. The web W is guided through the dryer section and held in contact with the heated cylinders by an endless belt A which is fluid permeable and is commonly referred to as a dryer felt or fabric. An upper dryer fabric or belt 22 holds the paper web W against heated cylinders 10–14 and a lower belt 24 guides and holds the paper web in contact with the lower cylinders 16–18. By contacting the paper web W, the dryer fabrics A press and maintain the web in intimate heat transfer contact with the dryer cylinders for the removal of water and other fluids from the paper web.

In conventional woven dryer fabrics, dryer fabric construction is described in terms of yarns or elements extending in the machine direction, which is the direction the paper web travels in the dryer section, and yarns or elements extending in the cross-machine direction, which is the direction across the width and transverse to the direction in which the web travels.

Referring now in more detail to the drawings, dryer fabric A includes a plurality of side-by-side warp yarn elements such as 30, 32, 34, and 36, illustrated, which extend in the machine direction in the fabric and are woven with weft elements in the cross-machine direction. The warp strands are interwoven with a first plurality of weft elements 40 to define a first layer 42 in the dryer fabric. The warp elements are interwoven with a second plurality of weft elements 44 to define a second layer 46 in the dryer fabric.

In a preferred embodiment, the warp elements and weft elements are single strands of polyester monofilament. While any suitable monofilament material may be utilized, a 0.020 diameter polyester monofilament has been found particularly suitable for use in the warp and weft strands of the first and second layers 42 and 46.

A third plurality of weft elements B are woven with warp elements 30–36 to form an intermediate layer 50. Shed spaces 52 are formed in the intermediate layer by crossings of adjacent warp elements such as 30–36. Weft elements B are inserted in these shed spaces. If left open, a dryer fabric having a high permeability is provided (500–700 cfm).

It has been found according to the present invention that a cabled multi-filament weft element B consisting of a number of single low-melt plastic monofilament strands 54 twisted together in spiraled undulations 56 may be advantageously woven and utilized as the weft element in the intermediate layer. The cabled multi-filament element is softer and more flexible than a single monofilament of equivalent diameter which allows the multi-filament to be pushed back more during beat-up and fill the voids and crevices of the shed space. The softer, more flexible multi-filament has the ability to contour to the shapes of the warp ends in forming the shed spaces further reducing the voids. More picks per inch of the cabled multifilament may be inserted. The result of the above is a more complete pre-melt coverage of the shed psace and closure of the intermediate fabric mesh.

In the pre-melt weaving process, the cabled multifilament yarn is characterized by twist knuckles 58 caused by the spiraled undulations 56 which have a tendency to close some of the void area.

In the process of heat treating the multi-filament yarn woven in the fabric, the individual low-melt nylon monofilament strands twisted together in the multi-filament yarn undergo a melt and expansion whereby the pre-melt voids in the sheds are filled more completely. Due to the multiple number of individual monofilament strands, as compared to a single monofilament of equivalent diameter, there is more heat penetration of the low-melt nylon material per unit time which causes the cabled multi-filament to melt and flow more quickly during heat treating.

In practice, two monofilament strands 54 may be Z-twisted to form a twisted pair. Three of the twisted pairs are then S-twisted to form cabled a weft element B. This produces balanced twist forces in the multi-filament strand which reduces the liveliness and kinking of the strand for better handling and weavability. In the illustrated embodiment six monofilament strands 54 are utilized having a 0.008 inch diameter for an overall effective diameter of 0.025 inches. It is to be understood, of course, that other numbers and sizes of low-melt monofilament may also be utilized within the scope of the present invention.

Figure 2:
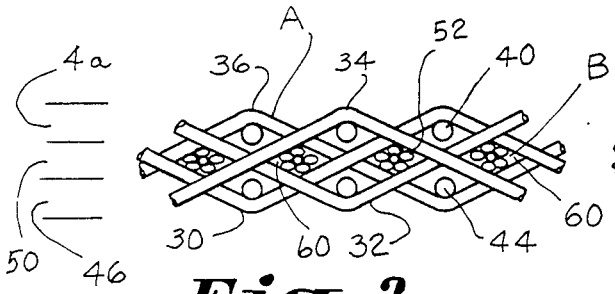
FIG. 2 is a longitudinal section of a fluid permeable fabric constructed according to the present invention incorporating a multi-filament weft consisting of twisted low-melt monofilament in an intermediate layer.
Figure 6:
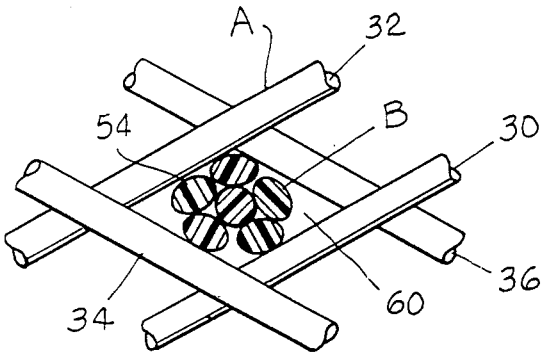
FIG. 6 is an enlarged section of FIG. 2 illustrating pre-melt void areas formed in the sheds of the intermediate layer.

In FIGS. 2 and 6, the fabric A is illustrated after being woven with the low-melt multi-filament weft element B, but before being heat treated. It will be noted that the weft elements B, while allowing more pre-melt closure of the shed spaces 52 than a relatively stiff single monofilament of equivalent diameter, still leaves some void area such as 60 in the sheds.

Figure 3:
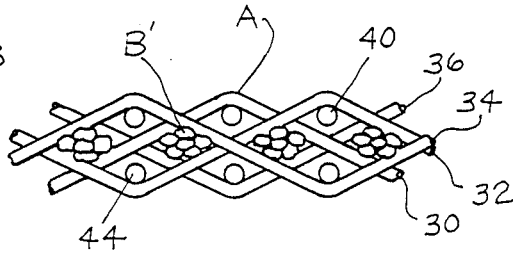
FIG. 3 is a longitudinal section illustrating the cable of FIG. 2 wherein the twisted low-melt monofilament of the multi-filament weft element have been subjected to heat treatment.
Figure 4:
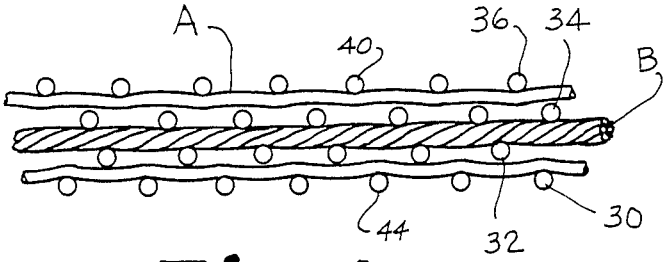
FIG. 4 is a lateral section of a dryer fabric having a multi-filament weft element inserted in an intermediate layer consisting of twisted monofilament strands in accordance with the present invention.
Figure 7:
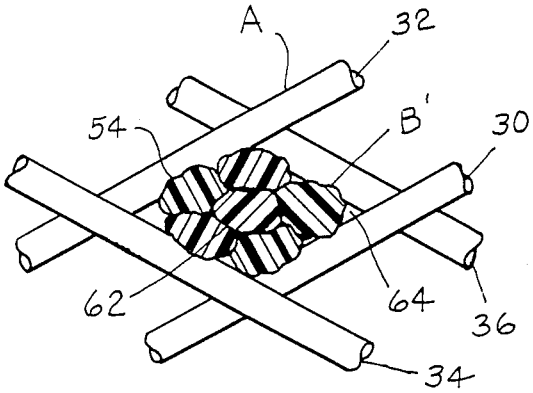
FIG. 7 is an enlarged section of the cable of FIG. 3 illustrating filling of the void areas of the shed in the intermediate layer.
Figure 8:
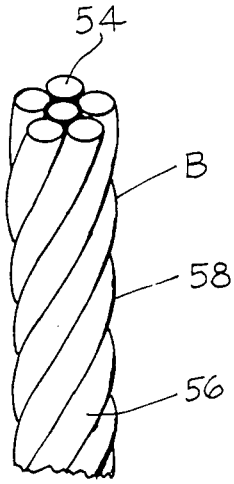
FIG. 8 is an isometric of a cabled multi-filament weft element according to the invention which consists of twisted low-melt monofilament strands.

Referring now to FIGS. 3 and 7, the invention is illustrated after the basic fabric A has been subjected to a heat treating process whereby the fabric is thermally set and the polymeric material is caused to expand and close the fabric resulting in a low fabric permeability. The individual monofilament strands of melt weft element B′ fuse together, such as at 62, while flowing into the void areas 60 in the form of melt.

By low-melt polymeric material disclosed herein, it is meant a material which will begin to melt and will expand at a temperature below that at which the remaining monofilament material in the fabric will become thermally set, but will be stable at the operating temperature of the dryer section. A suitable low-melt polymeric material is a low-melt nylon made by The Shakespear Company of Columbia, S.C. and identifiable as product no. WNX 40-23. Other suitable low-melt thermoplastics may also be utilized such as polypropylene.

It is to be understood that the warp strands 30–36 are repeated in a four-harness repeat pattern as illustrated and that the weaving of the fabric on a conventional loom having been taught the invention herein would be well within the skill of one in the weaving art.

Figure 5:
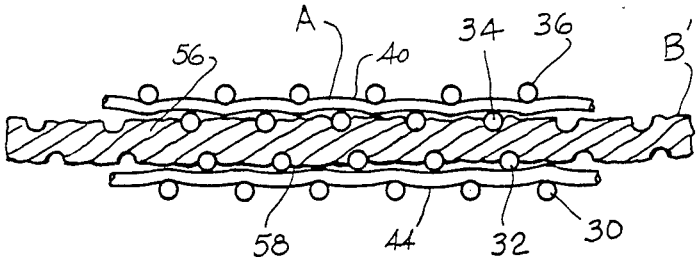
FIG. 5 is a longitudinal section of the cable of FIG. 4 illustrating the cabled multi-filament weft element after heat treatment.

In accordance with the present invention, after the basic fabric A is woven, it is placed on a suitable stretcher frame which may be any conventional frame such as a Hechtenberg stretcher, and subjected to a heat treating process by which the low-melt weft B is caused to flow in a swelling and expansion action to more completely fill shed spaces. The material will also expand between the adjacent crossing warp strands 30, 32, 34, 36 forming the shed to occupy spaces between the warp strands and interlock the strands together providing a more integral, stable fabric structure as can best be seen in FIG. 5.

The low-melt B will expand laterally to fill the spaces 60 on either side of the untreated weft element leaving a much smaller area 64 untreated. Weft elements B expand while the remaining monofilament fabric has some slight shrinkage during the heat treatment process. The monofilaments of weft B randomly expand between and past the warp strands forming sheds to interlock these strands together while at the same time reducing the cfm. The result is a low permeability fabric having improved fabric stability during repeated operation in the dryer section and the like.

In accordance with the method of the present invention, after the woven fabric is completed, the fabric is placed on the stretcher frame and finished in an end-to-end construction by known seam techniques. On the stretcher frame, the fabric is passed about a heated cylinder heated to a temperature of approximately 400 degrees Fahrenheit and placed under a tension pressure of 10 pounds per linear inch. The low-melt nylon has a melting point in the range of 360–385 degrees such that at approximately 380 degrees the low-melt nylon material begins to melt and expand. The fabric runs on the stretcher approximately two minutes after the temperature of 400 degrees is obtained. At this temperature, the polyester monofilament material will be thermally set and thermally stable whereby its dimensions remain unchanged within the required tolerance during use under normal dryer operating temperatures and pressure. The temperature is then reduced to approximately 100 degrees Fahrenheit. After obtaining this temperature, pressure (tension) is removed from the fabric and the fabric is removed from the stretcher frame.

After the fabric A is finished, the fabric is trimmed to make sure it has a predetermined width as desired for operation on the papermaking machine and a hot knife is passed along the edges to seal the edges joining the filling strands together as integral fabric structure.

While a preferred embodiment of the invention has been described using specific terms, such description is for illustrative purposes only, and it is to be understood that changes and variations may be made without departing from the spirit or scope of the following claims.

What is claimed is:

1. A method of constructing a woven fabric for a dryer section of a papermaking machine to provide a fabric having a desired low fabric permeability comprising:

weaving a plurality of warp elements with a first plurality of weft elements to define a first fabric layer;

weaving a second plurality of weft elements with said warp elements to define a second fabric layer;

weaving a third plurality of weft elements with said warp elements to define an intermediate fabric layer between said first and second fabric layers;

selecting each said weft element of said third plurality of weft elements in said intermediate layer to be a cabled multi-filament element comprising a number of individual low-melt polymeric monofilament strands twisted together in spiraled undulations providing a soft texture for closer beating-up of said third plurality of weft elements in said intermediate layer of fabric during weaving; and heating said fabric and twisted low-melt monofilament strands of said cabled multi-filament elements woven therein causing said twisted low-melt monofilament strands of said cabled multi-filament elements to expand and more completely fill and occupy said shed spaced of said intermediate fabric layer to reduce the permeability of the fabric and provide a low permeability fabric characteristic.

2. The method of claim 1 including sealing the lateral edges of the dryer fabric by passing a hot knife along the edges.

3. The method of claim 2 including heating the dryer fabric after said polymeric material begins to expand to a temperature above the melting point of said polymeric material to thermally set and stabilize the dryer fabric.

4. A method of constructing a multiple layer woven dryer fabric for a papermaking machine comprising:

weaving a plurality of monofilament warp elements with a first plurality of monofilament weft elements to define a plurality of fabric layers;

weaving a plurality of multi-filament weft elements with said warp elements to create an intermediate fabric layer having shed spaces defined by crossings of adjacent warp yarns in said intermediate layer;

selecting each of said multi-filament weft elements to include a number of twisted monofilament strands of a low-melt polymeric material having a soft texture defined by spiraled undulations which conform to the weaving of said warp elements and reduce pre-melt void areas in said intermediate layers;

heating said fabric causing said twisted low-melt monofilament polymeric strands of said cabled multi-filament weft elements to fuse substantially together and expand in said intermediate fabric layer and more completely close said void areas in said intermediate fabric layer and interlock with said interwoven strands to provide integral fabric structure having a desired fabric permeability characteristic.

* * * * *